US010891908B1

(12) United States Patent
Liao et al.

(10) Patent No.: US 10,891,908 B1
(45) Date of Patent: Jan. 12, 2021

(54) DISPLAY SYSTEM AND DRIVER CIRCUIT THEREOF

(71) Applicant: NOVATEK Microelectronics Corp., Hsin-Chu (TW)

(72) Inventors: Yen-Tao Liao, Hsinchu (TW); Shih-Ting Huang, Hsinchu County (TW); Hsien-Po Huang, Hsinchu (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

(21) Appl. No.: 16/672,524

(22) Filed: Nov. 4, 2019

(51) Int. Cl.
*G09G 3/34* (2006.01)
*G09G 3/36* (2006.01)

(52) U.S. Cl.
CPC ..... *G09G 3/3611* (2013.01); *G09G 2310/027* (2013.01); *G09G 2360/16* (2013.01)

(58) Field of Classification Search
None
See application file for complete search history.

(56) References Cited

U.S. PATENT DOCUMENTS

2008/0246780 A1* 10/2008 Cho ..... G02F 1/133602 345/690

* cited by examiner

*Primary Examiner* — Roy P Rabindranath
(74) *Attorney, Agent, or Firm* — Winston Hsu

(57) ABSTRACT

A display system includes a display device and a driver circuit. The display device has a first panel and a second panel, wherein the first panel and the second panel are disposed with a gap therebetween. The driver circuit is coupled to the display device and includes a protection circuit. The protection circuit, coupled to the second panel of the display device, is configured to generate a gray scale data to be outputted to a pixel among a plurality of pixels of the second panel according to a luminance corresponding to the pixel and according to whether a protection function is enabled.

14 Claims, 7 Drawing Sheets

DISPLAY SYSTEM AND DRIVER CIRCUIT THEREOF

BACKGROUND OF THE INVENTION

1. Field of the Invention

The present invention relates to a display system and a driver circuit, and more particularly, to a liquid crystal display system and a related driver circuit.

2. Description of the Prior Art

A liquid crystal display (LCD), which is a flat panel display having the advantages of low radiation, light weight and low power consumption, is widely used in various information technology (IT) products such as notebook computers, personal digital assistants (PDA), and mobile phones. The principle of LCD is to vary the arrangement of liquid crystal molecules in a liquid crystal layer by varying the voltage difference between two terminals of the liquid crystal layer. The transparency of the liquid crystal layer may change accordingly, which is further incorporated with the light source provided by a backlight module to display images.

The LCD usually includes a driver chip. After image data is transmitted from a host to the driver chip, the image data may be processed by the driver chip and sent to the panel from the driver chip. People in the industry are making their best efforts to improve the image quality such as resolution and contrast. As for the driver chip, various image processing techniques are applied to achieve this purpose. In addition, privacy protection for electronic products and screen becomes an important issue to be dealt with.

SUMMARY OF THE INVENTION

It is therefore an objective to provide a display system and a driver circuit capable of enhancing image contrast and providing privacy protection function.

An embodiment of the present invention discloses a display system, which comprises a display device and a driver circuit. The display device has a first panel and a second panel, wherein the first panel and the second panel are disposed with a gap therebetween. The driver circuit is coupled to the display device and comprises a protection circuit. The protection circuit, coupled to the second panel of the display device, is configured to generate a gray scale data to be outputted to a pixel among a plurality of pixels of the second panel according to a luminance corresponding to the pixel and according to whether a protection function is enabled.

Another embodiment of the present invention discloses a driver circuit of a display system. The display system comprises a display device having a first panel and a second panel. The driver circuit comprises a protection circuit. The protection circuit, coupled to the second panel of the display device, is configured to generate a gray scale data to be outputted to a pixel among a plurality of pixels of the second panel according to a luminance corresponding to the pixel and according to whether a protection function is enabled. Wherein, the first panel and the second panel are disposed with a gap therebetween.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
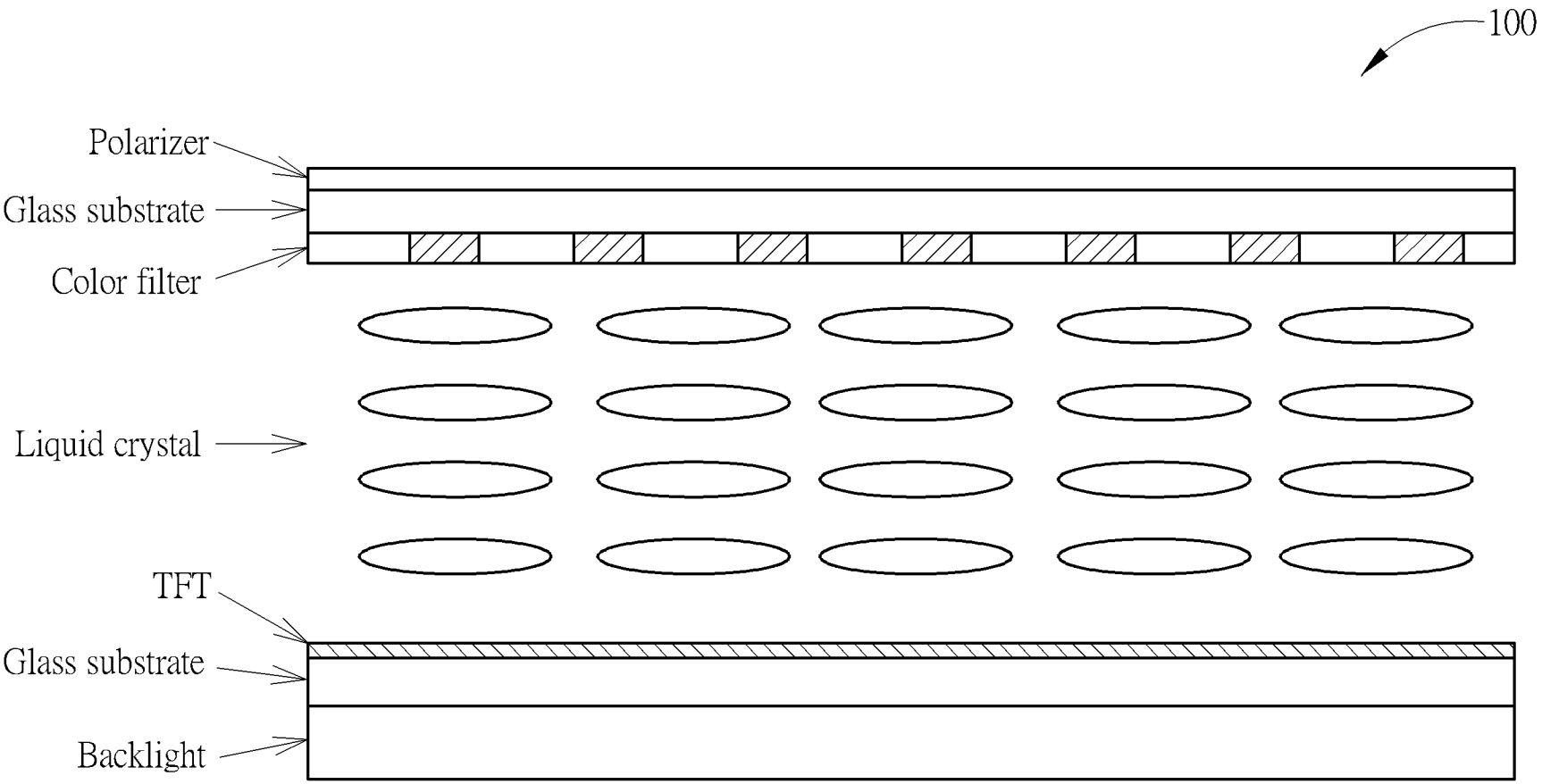
FIG. 1 is a cross-sectional diagram of a general liquid crystal display (LCD) panel.

Please refer to FIG. 1, which is a cross-sectional diagram of a general liquid crystal display (LCD) panel 100. As shown in FIG. 1, the LCD panel 100 includes layers such as a polarizer film, glass substrates, a color filter, a thin-film transistor (TFT) layer, a backlight source, and a liquid crystal layer. During the operations of the LCD panel 100, light can be outputted from the backlight source. A current flowing through the TFT generates variations on electric fields, which twists the liquid crystal molecules to change light polarities. The color filter controls each subpixel to deliver one of three primary colors, i.e., red, blue and green, so as to construct a desired image on the panel.

Figure 2:
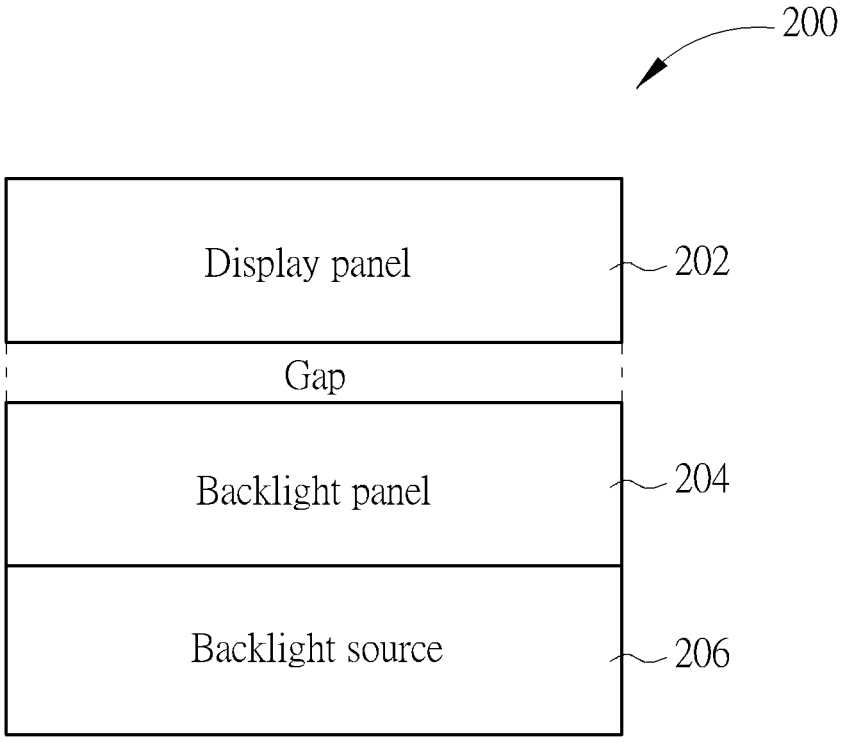
FIG. 2 is a schematic diagram of an LCD device according to an embodiment of the present invention.

In order to enhance the contrast of the display image, an LCD device with a dual panel structure is provided. Please refer to FIG. 2, which is a schematic diagram of an LCD device 200 according to an embodiment of the present invention. As shown in FIG. 2, the LCD device 200 includes a display panel 202, a backlight panel 204 and a backlight source 206. Each of the display panel 202 and the backlight panel 204 has a structure similar to the structure of the LCD panel 100, to realize the dual panel structure. More specifically, the display panel 202 includes a polarizer film, glass substrates, a color filter, a TFT layer, and a liquid crystal layer; that is, the display panel 202 has every layer in the LCD panel 100 except for the backlight source. The backlight panel 204 is configured to control the backlight intensity in each pixel, and thus is not required to generate color information of each pixel; hence, the structure of the backlight panel 204 is similar to the structure of the display panel 202 except that the backlight panel 204 does not include the color filter. The display panel 202 and the backlight panel 204 are disposed with a gap therebetween, so as to achieve confidential and privacy protection.

Figure 3:
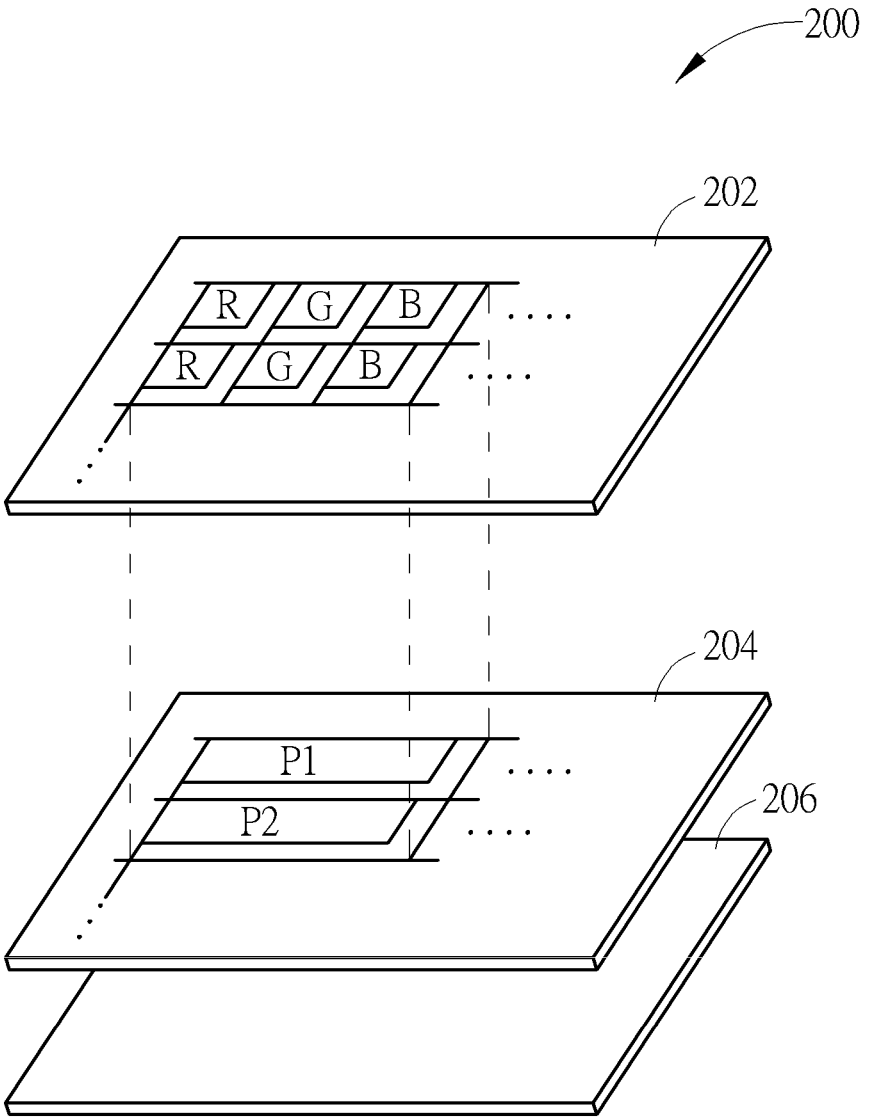
FIG. 3 is a schematic diagram of pixels of the display panel and the backlight panel.

In an embodiment, each pixel of the display panel 202 includes three subpixels having three primary colors, i.e., red (R), blue (B) and green (G), respectively, and each pixel of the display panel 202 is superposed on one pixel (e.g., P1, P2, etc.) of the backlight panel 204, as shown in FIG. 3. For example, in a 4k2k panel having the dual panel structure as the LCD device 200, there are 3840×2160 pixels in each of the display panel 202 and the backlight panel 204. The display panel 202 includes 3840×2160×3 subpixel units while the backlight panel 204 includes 3840×2160 pixel units or subpixel units.

Figure 4:
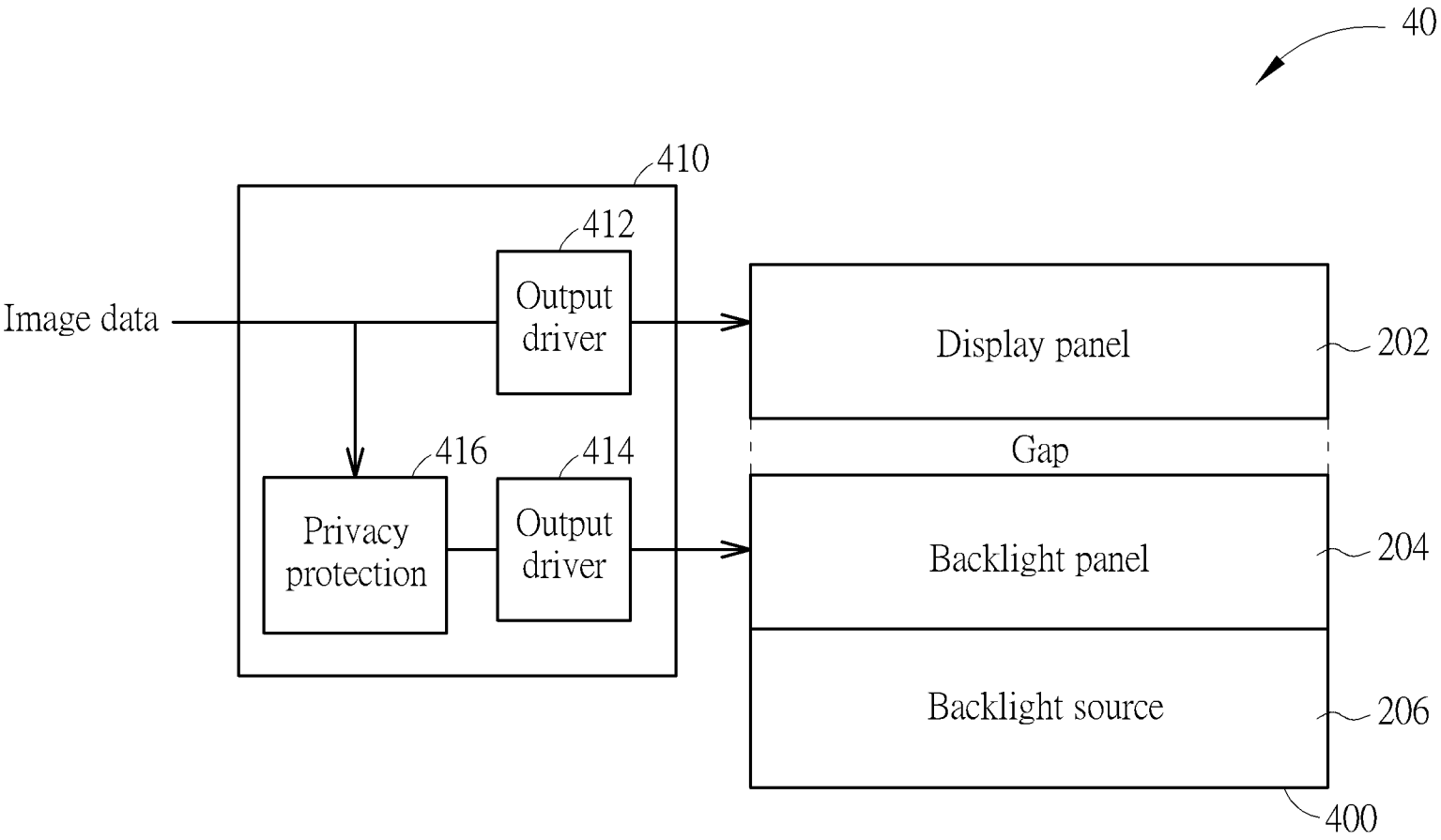
FIG. 4 is a schematic diagram of a display system according to an embodiment of the present invention.

Please refer to FIG. 4, which is a schematic diagram of a display system 40 according to an embodiment of the present invention. As shown in FIG. 4, the display system 40 includes an LCD device 400 and a driver circuit 410. The LCD device 400 has a similar structure as the LCD device 200, where the display panel 202 and the backlight panel 204 are disposed with a gap therebetween, and the backlight source 206 is configured to provide backlight for displaying images. The driver circuit 410 includes output drivers 412 and 414 and a privacy protection circuit 416. The output driver 412 is configured to transmit image data to the subpixels of the display panel 202 in a sequence, and each subpixel receives its image data in a data cycle. Correspondingly, the output driver 414, which is coupled to the privacy protection circuit 416, is configured to transmit gray scale data to the corresponding pixel of the backlight panel 204 in the data cycle.

In order to increase the contrast of the display image, the gray scale data to be outputted to the backlight panel 204 may be determined according to the image data transmitted to corresponding subpixels which are superposed on the target pixel of the gray scale data on the backlight panel 204, to control the penetration degree of backlight through the backlight panel 204. For example, the gray scale data outputted to a pixel of the backlight panel 204 may have a higher magnitude if the image data for the corresponding subpixels of the display panel 202 has higher luminance; and the gray scale data outputted to a pixel of the backlight panel 204 may have a lower magnitude if the image data for the corresponding subpixels of the display panel 202 has lower luminance. In this manner, the contrast of the display image may be increased, since the higher gray scale data for the pixels having higher luminance may generate higher penetration degree of backlight through the backlight panel 204. Each pixel may receive a respective gray scale data for controlling its penetration degree of backlight, and thus the backlight intensity in each pixel may be controlled independently and flexibly; hence, the contrast may be enhanced to a satisfactory level.

In general, the driver circuit 410 may include a timing controller (which is omitted in FIG. 4 for brevity), which processes the input image data and forwards the image data to the output driver 412 (such as a source driver), allowing the output driver 412 to output the image data to the display panel 202. Also, the timing controller may send the luminance information of the image data to the privacy protection circuit 416, allowing the privacy protection circuit 416 to generate the corresponding gray scale data to be outputted to the backlight panel 204.

Figure 5:
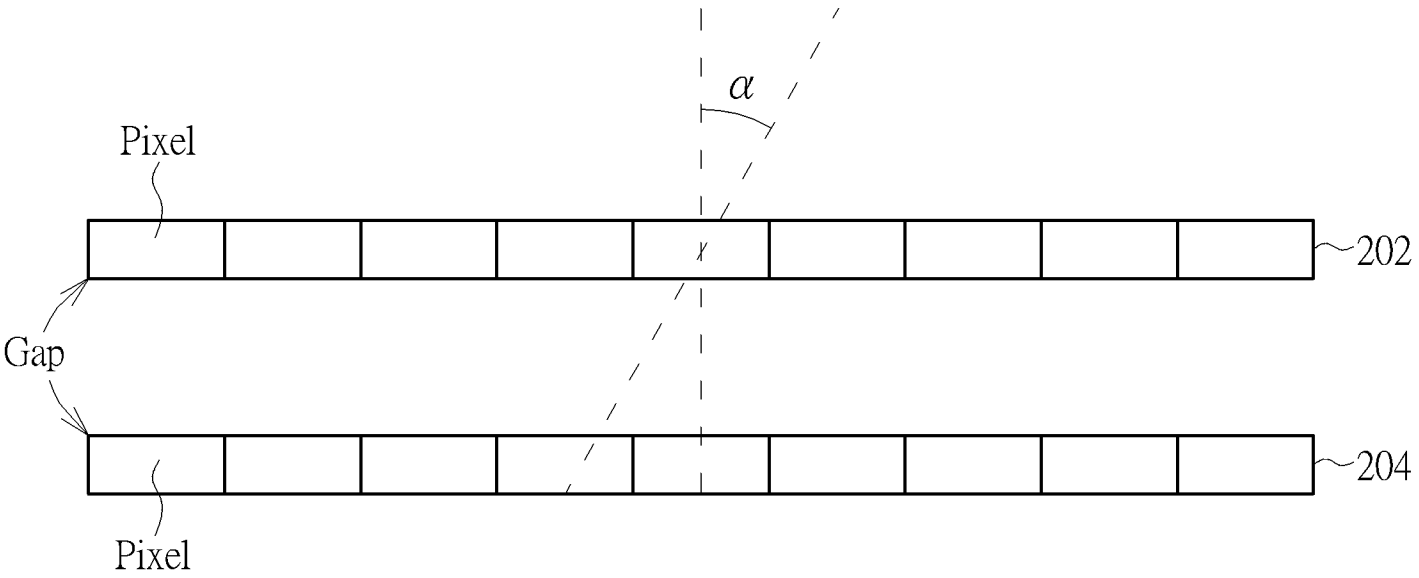
FIG. 5 is a side view diagram of the LCD device.
Figure 6A:
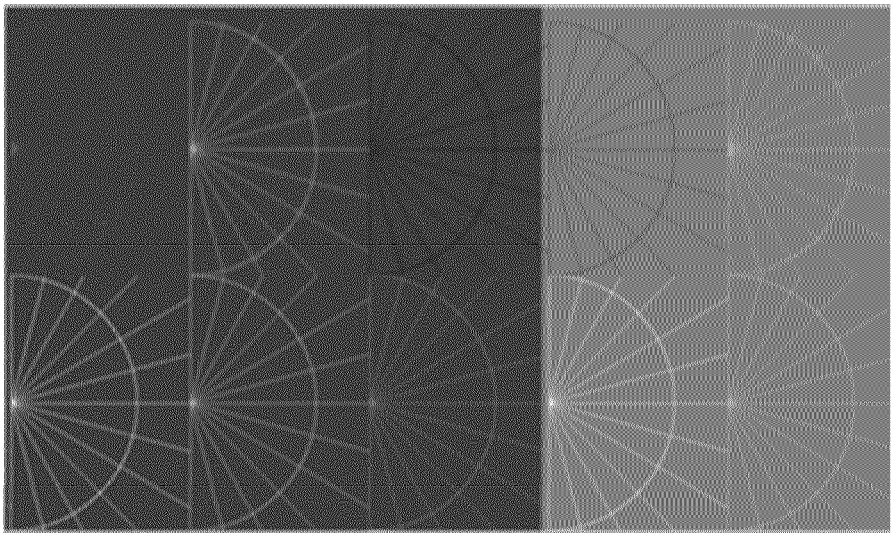
FIGS. 6A and 6B are schematic diagrams of an image seen by a viewer from the top view and the oblique view, respectively.
Figure 6B:
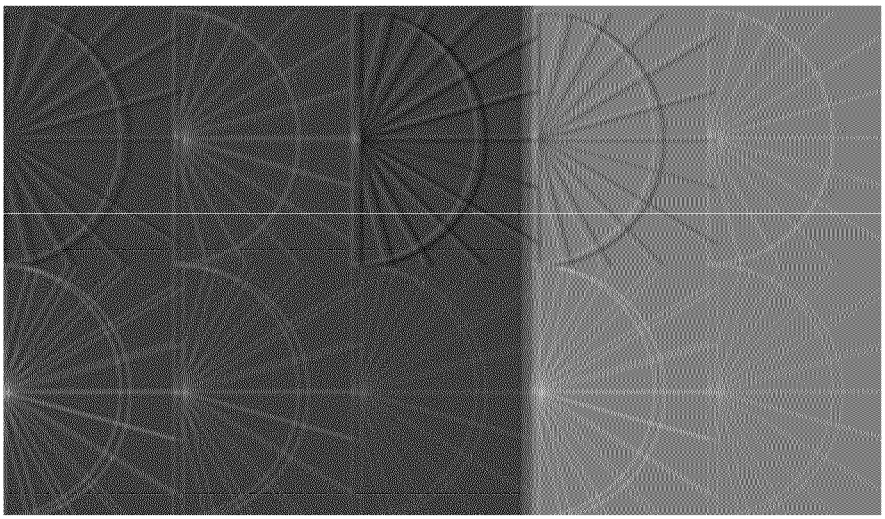

Please note that in the LCD device 200 or 400, there is a gap between the display panel 202 and the backlight panel 204. The gap may separate the two panels 202 and 204, and thereby influence the image seen from an oblique view. FIG. 5 illustrates a side view diagram of the LCD device 200, where each section in the display panel 202 or the backlight panel 204 refers to a pixel. When a viewer watches the panel from the top view, the viewer may see a normal image, as shown in FIG. 6A. When a viewer watches the panel from an oblique view with an angle $\alpha$, the image in each pixel may be influenced by the backlight control of an adjacent pixel. In such a situation, ghost images may appear on the displayed image frame, especially when the image shows more texts and/or lines, as shown in FIG. 6B. Since the image detail cannot be clearly seen from the oblique view direction, a peek at the panel may be prevented, which achieves the privacy protection of the LCD device.

Figure 7:
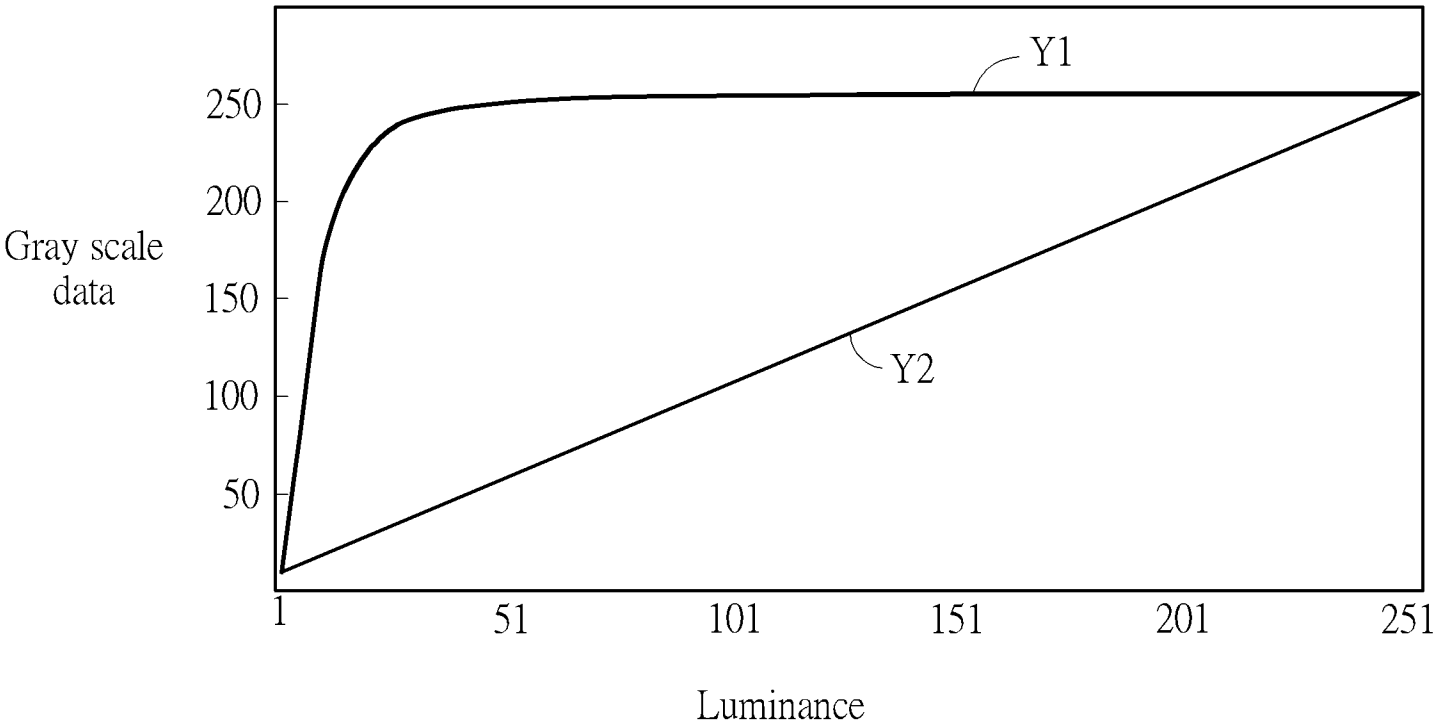
FIG. 7 is a schematic diagram of conversion of the gray scale data and luminance according to an embodiment of the present invention.

In an embodiment, the privacy protection function may be flexibly controlled by the privacy protection circuit in the driver circuit. Please return to refer to FIG. 4, where the privacy protection circuit 416 is configured to generate gray scale data according to the luminance of the image data for each pixel. The gray scale data may be determined based on the privacy protection function. Please refer to FIG. 7, which is a schematic diagram of conversion of the gray scale data and luminance according to an embodiment of the present invention. When the privacy protection function is disabled, the privacy protection circuit 416 may convert the luminance of image data to the gray scale data following the curve Y1. The curve Y1 shows that images with medium or higher luminance are displayed with almost full backlight intensity, while the images with extremely low luminance (e.g., lower than 30) are displayed with lower backlight intensity under the backlight control of each pixel in the backlight panel 204. The curve Y1 may achieve higher contrast of the image. Since the privacy protection function is disabled, the image may be clear in both top view and oblique view since the backlight is nearly fully turned on for most luminance levels.

On the other hand, when the privacy protection function is enabled, the privacy protection circuit 416 may convert the luminance of image data to the gray scale data following the curve Y2, which leads to gray scale data different from those obtained based on the curve Y1 under the same luminance. In detail, the conversion of the curve Y2 may be considered as a linear conversion, where the higher luminance may be converted into higher gray scale data with an approximately linear relationship. Therefore, different luminance may lead to different backlight intensities on the backlight panel; hence, any two pixels having different image data may usually be corresponding to different gray scale data for the backlight panel. If a viewer watches the panel from an oblique view angle or side view angle, the viewer may see a blurred image since each pixel may reflect a wrong backlight intensity at the oblique view angle or side view angle. If the image includes texts and/or characters, the texts and/or characters may become blurred at the oblique view angle, which achieves the privacy or confidential protection of the LCD device.

Please note that the present invention aims at providing a display device with a dual panel structure controlled by a driver circuit having a privacy protection circuit, where the two panels of the display device have a gap therebetween, and the privacy protection circuit may enable the privacy protection function to prevent a peek from an oblique view angle. Those skilled in the art may make modifications and alternations accordingly. For example, in the dual panel structure, the gap between the two panels may be implemented in any manner. In an embodiment, the gap may be an air gap or vacuum between the two panels, where the two panels are combined and connected through the non-display area. Preferably, the width of the gap may be greater than a value that allows the displayed text to become blurred from an oblique view angle when the privacy protection function is enabled. The width of the gap may also be adjustable by the producer of the display device. A wider gap may lead to more evident ghost images, which achieve better peek prevention effects. Further, in the above embodiments, each pixel has three subpixels with three primary colors, but those skilled in the art should understand that the structures of pixels and subpixels are not limited thereto. Also, in the above embodiments, the LCD device is applied to achieve the high contrast and privacy protection effects; in another embodiment, the dual panel structure and related implementation may be applied to other type of display device having the backlight source.

In addition, the privacy protection circuit may be implemented in any manner. In detail, the conversion of gray scale data is based on the curve shown in FIG. 7, where the values of the luminance refer to digital values indicating the magnitude of the luminance, and the values of the gray scale data are digital data to be converted into analog voltages for controlling the TFTs on the backlight panel 204. In an embodiment, the conversion information (including the curve regarding privacy protection and the curve without privacy protection) may be stored in a lookup table, and the privacy protection circuit 416 may refer to the lookup table to find the proper gray scale value according to the luminance for the target pixel and also according to whether the privacy protection function is enabled. In an embodiment, the luminance value obtained by the privacy protection circuit 416 may be a function of luminance with respect to the red, green, and blue image data of the target pixel, and the luminance value may further be converted into the gray scale data to be transmitted to the backlight panel 204.

To sum up, the present invention provides a display system and a driver circuit which are capable of enhancing image contrast and realizing privacy protection. In an embodiment, the display device has a dual panel structure with a display panel and a backlight panel, and a gap may be disposed between the two panels of the display device. With the disposition of the gap, the images from an oblique view angle may become blurred, which achieves the privacy protection effects. The driver circuit of the present invention is configured to output image data to the display panel and output gray scale data corresponding to luminance of the image data to the backlight panel. The driver circuit may include a privacy protection circuit, which is configured to generate the gray scale data to be transmitted to the backlight panel according to the luminance information and also according to whether the privacy protection function is enabled or not. In general, the gray scale data may enhance the image contrast by controlling the backlight intensity in each pixel. When the privacy protection function is enabled, the privacy protection circuit may perform linear conversion between the luminance and the outputted gray scale data, to prevent a peek from an oblique view angle and thereby achieve privacy protection with the gap disposed between the panels.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display system, comprising:

a display device, having a first panel and a second panel, wherein the first panel and the second panel are disposed with a gap therebetween; and a driver circuit, coupled to the display device, the driver circuit comprising:

a protection circuit, coupled to the second panel of the display device, configured to generate a gray scale data to be outputted to a pixel among a plurality of pixels of the second panel according to a luminance corresponding to the pixel and according to whether a protection function is enabled;

wherein a width of the gap is greater than a value that allows a text displayed on the display device to become blurred from an oblique view angle when the protection function is enabled.

2. The display system of claim 1, wherein the first panel comprises a plurality of pixels and each of the plurality of pixels of the first panel comprises a plurality of subpixels, and each of the plurality of pixels of the first panel is superposed on one pixel among the plurality of pixels of the second panel.

3. The display system of claim 2, wherein the driver circuit further comprises:

a first output driver, configured to transmit an image data to a subpixel among the subpixels of the first panel in a data cycle; and a second output driver, coupled to the protection circuit, configured to transmit the gray scale data to the pixel of the second panel in the data cycle;

wherein the gray scale data is determined according to the image data transmitted to the subpixel in the pixel of the first panel superposed on the pixel of the second panel.

4. The display system of claim 1, wherein a width of the gap is adjustable.

5. The display system of claim 1, wherein the protection circuit converts the luminance corresponding to the pixel into a first gray scale data when the protection function is enabled, and converts the luminance corresponding to the pixel into a second gray scale data when the protection function is disabled.

6. The display system of claim 5, wherein the conversion of the luminance into the first gray scale data is substantially a linear conversion.

7. The display system of claim 1, wherein the gray scale data corresponds to a penetration degree of a backlight of the display device.

8. A driver circuit of a display system, the display system comprising a display device having a first panel and a second panel, the driver circuit comprising:

a protection circuit, coupled to the second panel of the display device, configured to generate a gray scale data to be outputted to a pixel among a plurality of pixels of the second panel according to a luminance corresponding to the pixel and according to whether a protection function is enabled;

wherein the first panel and the second panel are disposed with a gap therebetween;

wherein a width of the gap is greater than a value that allows a text displayed on the display device to become blurred from an oblique view angle when the protection function is enabled.

9. The driver circuit of claim 8, wherein the first panel comprises a plurality of pixels and each of the plurality of pixels of the first panel comprises a plurality of subpixels, and each of the plurality of pixels of the first panel is superposed on one pixel among the plurality of pixels of the second panel.

10. The driver circuit of claim 9, further comprising:

a first output driver, configured to transmit an image data to a subpixel among the subpixels of the first panel in a data cycle; and a second output driver, coupled to the protection circuit, configured to transmit the gray scale data to the pixel of the second panel in the data cycle;

wherein the gray scale data is determined according to the image data transmitted to the subpixels in the pixel of the first panel superposed on the pixel of the second panel.

11. The driver circuit of claim 8, wherein a width of the gap is adjustable.

12. The driver circuit of claim 8, wherein the protection circuit converts the luminance corresponding to the pixel into a first gray scale data when the protection function is enabled, and converts the luminance corresponding to the pixel into a second gray scale data when the protection function is disabled.

13. The driver circuit of claim 12, wherein the conversion of the luminance into the first gray scale data is substantially a linear conversion.

14. The driver circuit of claim 8, wherein the gray scale data corresponds to a penetration degree of a backlight of the display device.

* * * * *